United States Patent [19]

Mazoin

[11] Patent Number: 4,759,463

[45] Date of Patent: Jul. 26, 1988

[54] AIR-TIGHT BOX FORMING A CONTAINER FOR VARIOUS PRODUCTS

[75] Inventor: Albert H. F. Mazoin, Condat sur Vezere, France

[73] Assignee: Plastigord "Plastiques du Perigord", Terrasson, France

[21] Appl. No.: 439,866

[22] Filed: Nov. 8, 1982

[30] Foreign Application Priority Data

Nov. 6, 1981 [FR] France ..... 81 20832

[51] Int. Cl.[4] ..... B65D 41/00

[52] U.S. Cl. ..... 220/270; 220/257; 220/359

[58] Field of Search ..... 220/257, 276, 270, 359, 220/256, 258

[56] References Cited

U.S. PATENT DOCUMENTS

| | | | |
|---|---|---|---|
| 499,734 | 6/1893 | Herndon | 220/276 |
| 2,998,158 | 8/1961 | Tupper | 220/276 |
| 3,318,477 | 5/1967 | Southwick et al. | 220/276 |
| 3,515,334 | 6/1970 | Jacobson | 220/270 |
| 3,572,579 | 3/1971 | Mueller et al. | 220/270 |
| 3,817,420 | 6/1974 | Heisler | 220/276 |
| 3,858,748 | 1/1975 | Marco | 220/276 |
| 4,040,561 | 8/1977 | Philippon | 220/259 |
| 4,091,930 | 5/1978 | Buchner et al. | 220/276 |
| 4,207,989 | 6/1980 | Ingemann | 220/270 |

*Primary Examiner*—Joseph Man-Fu Moy

*Attorney, Agent, or Firm*—Browdy and Neimark

[57] ABSTRACT

The box forming a container comprises a body forming a flange at a distance of the upper edge. A lid encases the body of the box and has a flange which is soldered typically through ultra-sounds, the soldered area extending not exactly up to breakage grooves.

19 Claims, 3 Drawing Sheets

AIR-TIGHT BOX FORMING A CONTAINER FOR VARIOUS PRODUCTS

BACKGROUND OF THE INVENTION

The present invention relates to a new box for containing various products which have to be air tight preserved during a more or less long time, said box being inviolably secured up to when the products contained therein are used.

The invention is extended in particular to manufacturing of boxes which can contain products which have to be preserved a long time, such boxes being up to now made of metal.

The prior art has made available a plurality of embodiments of boxes comprising a body covered by a lid fixed either by soldering or by crimping, or still by a combination of these two means, weaker resistance areas being provided either at the upper part of the box or in the lid for enabling to tear-off either the box or the lid and to have access to the products contained in the box.

U.S. Pat. No. 2,941,660 relates to a container having a cover capable of being permanently sealed subsequent to a merchandise-filling operation and further capable of being easily severed or separated by the consumer for further functioning as a container and a sealably detachable cover therefor. The container is preferably made of thermoplastic type material.

French Patent No. 78-32472 relates to a container made of plastics material and provided with a cover also of plastics material and sealed to the container preferably by vibrations, particularly ultra-sonic vibrations. A breakable portion is provided preferably in the container near the top portion thereof. Breakage of the breakable portion provides the cover with a ring shaped portion which may be fitted on the remaining portion of the container and thus constitute a removable cover.

U.S. Pat. No. 3,463,347 describes a closure normally for use in combination with the conventional can, said closure comprising an end closure member adapted to be crimped with the flared can body to form a flange and thereby seal the end of the can, said closure having an annular groove in the underside thereof in proximity to said flange, cutting means received in said groove, said cutting means having an upstanding cutting edge, said cutting means also having a portion thereof projecting through said closure, a torsion bar carried diametrically on the outer side of said closure and being secured to a portion of said cutting means extending through said closure.

French Patent No. 1,335,350 describes a container having a groove opening on the top thereof and containing an annular blade intended to cut a cover which is sealed onto the container.

French Patent No. 1,511,724 is concerned with a container in plastics material having a portion of its lateral wall which is resilient and which is further provided with bellow portions for compensation of temperature differences.

The present invention provides a new box of a very low manufacturing cost which may be sterilized and vacuum filled, and which is then easy to open without necessitating any tooling, without the user of the box being possibly hurt, the box having moreover the advantage of being re-usable.

The present invention concerns improvements which obviate the risk to form a too large or too thin soldered area and, moreover, the opening of the box is made extremely easy.

SUMMARY OF THE INVENTION

According to the invention, the box forming a container for various products, particularly alimentary products, is characterized in that it comprises a body forming a flange and a lid bearing on the flange and soldered to said flange on a width smaller than width of the flange which comprises means for breaking the part containing the soldered area.

These and other objects and advantages of the present invention will be apparent from the more detailed description which follows taken in conjunction with the accompanying drawings.

DESCRIPTION OF PREFERRED EMBODIMENTS

Turning to the drawings.

Figure 1:
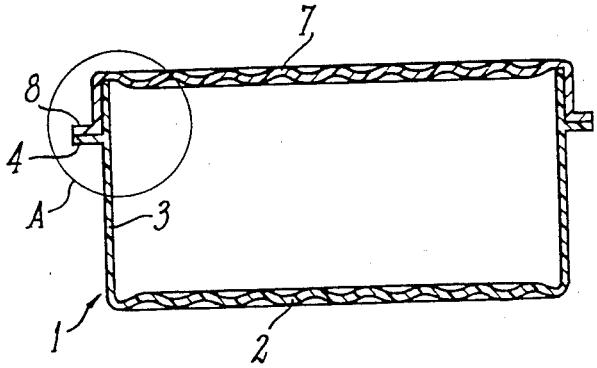
FIG. 1 is a cross-elevation view of a box according to the invention.

Turning now to the drawings in greater detail,

FIG. 1 diagrammatically shows an embodiment of a box according to the invention, this box comprising a body 1 forming a bottom 2, preferably corrugated, from which protrudes a raising side wall 3, the wall 3 forming, outwardly and at a distance from its upper edge 3*a*, a peripheral flange 4. The segment 5, which extends from the upper edge 3*a* up to above the flange 4, is used for guiding a fallen edge 6 of a lid 7 the top of which is also preferably corrugated. The fallen edge 6 of the lid forms, at its bottom part, a flange 8 which corresponds to the flange 4 of the body.

Both the body 1 and the lid 7 are manufactured in a soldable material preferably chosen among the materials which can support a sterilization temperature, i.e. at least 105° C. and preferably about 130° C. A plurality of materials, typically plastics material, can be used for fullfilling the above mentioned conditions and, among these materials, the so called sterilizable polypropylene is particularly advantageous since it permits a simple manufacturing by moulding and it has qualities suitable for making alimentary product containers.

Figure 2:
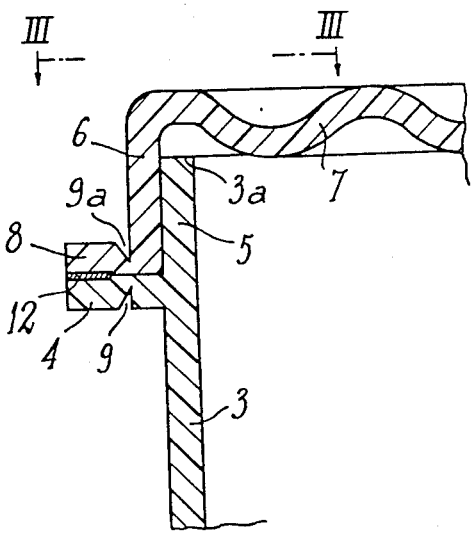
FIG. 2 is an enlarged cross-elevation view of a detail A shown in FIG. 1.
Figure 3:
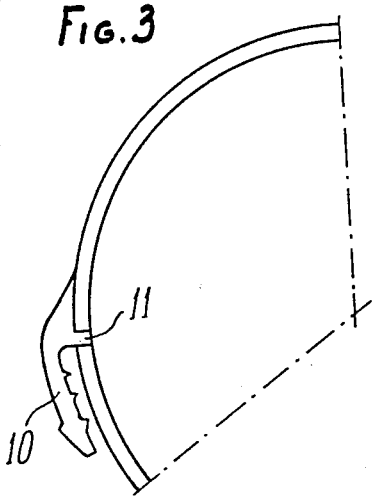
FIG. 3 is a view taken along line III—III of FIG. 2.

As shown in FIG. 2, the flanges 4 and 8 have grooves 9, 9a formed on all or portions of their periphery, these grooves forming breakage starts.

The flanges are also at least provided with a tongue 10 protruding near the breakage starts 11 for permitting to tear-off the flanges 4, 8 along the bottom of the grooves 9, 9a.

When the above described box is filled, the flanges 4 and 8 are soldered together along a soldered area 12 which extends on all the periphery of said flanges without however reaching a line passing by the bottom of the grooves 9, 9a. The soldered area 12 provides an air-tight fixation of the lid on the body. Soldering is advantageously made through ultra-sonic vibrations by means of sonotrodes when the box is made of plastics material, as explained above.

In the case of a metal box, soldering could be made by any means known in the art or, in case, a suitable glue could be used.

When the bottom 2 of the box and the lid 7 are corrugated at least in part, this permits that they are deformed when the box is filled and closed under vacuum. It is remarkable to notice that when the box is open, i.e. after the flanges 4, 8 have being torn-off as above explained, the box remains usable since the lid 6 can be re-positioned by engaging it on the protruding segment 5. Thus an alimentary product contained within the box can be protected and preserved either from the open air or a refrigerated atmosphere, according to the nature of the alimentary product contained in the box.

Figure 4:
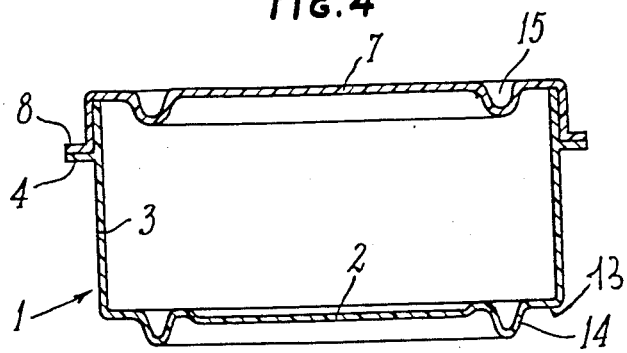
FIG. 4 is a cross-section similar to FIG. 1 of a development of the invention.

FIG. 4 shows that boxes made as above described can be provided so as to be placed the one above the other. In this case, the raising side wall 3 of the body 1 is provided with at least one support rim 14 protruding downwardly and corresponding to an annular groove 15 formed in the lid 7.

Figure 5:
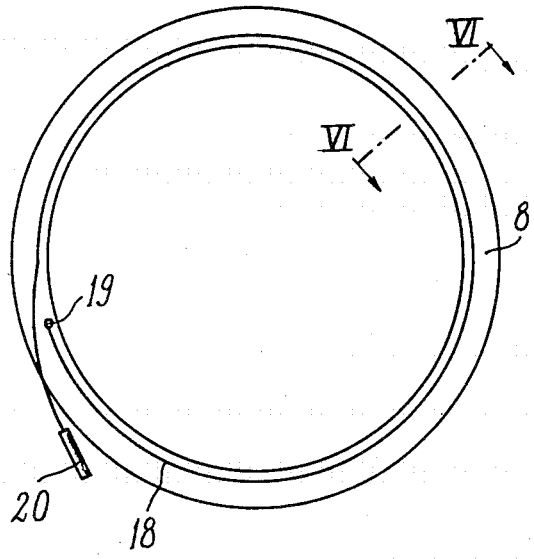
FIG. 5 is a view from above illustrating a variant of one of the features of the box of the preceding figures.
Figure 6:
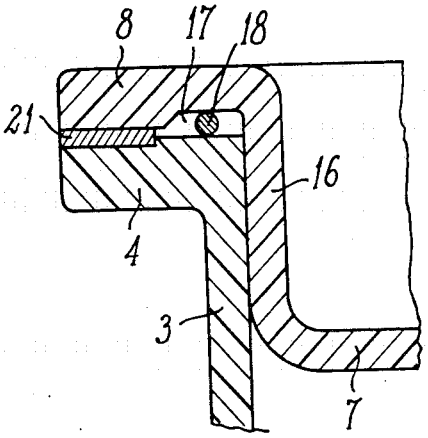
FIG. 6 is a cross-section taken along line VI—VI of FIG. 5.

FIGS. 5 and 6 show a slight variant of embodiment according to which the lid 7 is formed from the upper edge of the raising side wall 3. In this case, the lid 7 is provided to have a raising edge 16 at its periphery. A flange 8 is formed as previously for protruding from the raising edge 16 which is encased in the body of the box. The flange 8 forms in its portion near the raising edge 16 a peripheral recess 17 in which is placed a wire 18 made for example of steel, the wire being fixed by one of its ends as shown at 19, either in the flange 8, or on bottom of the lid 7. The tip end of the wire 18 is passed between the contacting parts of the flanges 4 and 8, and is provided with gripping means 20. Afterwards the flanges 4 and 8 are then subjected to a soldering step, preferably through ultra-sonic vibrations as explained hereinabove, here to provide a soldered area 21. This way of connecting the flanges 4 and 8 has for its effect to embed portions of the wire 18 within the soldered area 21 which is made, so that the connection between the flanges is perfectly air-tight. For opening the box, it suffices to exert a pull on the gripping means 20, the wire 18 insuring a shearing of the soldered area 21.

The concave curved shape of the lid 7, in the embodiment just above described, permits to easily place the boxes the one above the other, either by providing (as in FIG. 4) a peripheral shoulder 13 near the bottom 2 or by providing that the lateral wall 3 is tapered, i.e. that the box is of a truncated cone shape or a truncated pyramid shape, according to the case the box is of a circular or polygonal cross-section.

Figure 7:
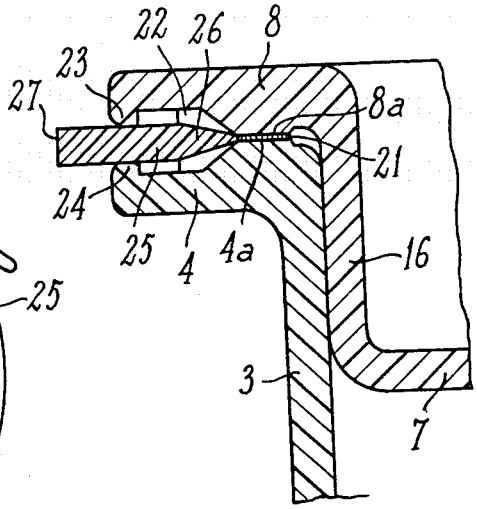
FIG. 7 is a cross-section similar to FIG. 6 of an other variant of embodiment.
Figure 8:
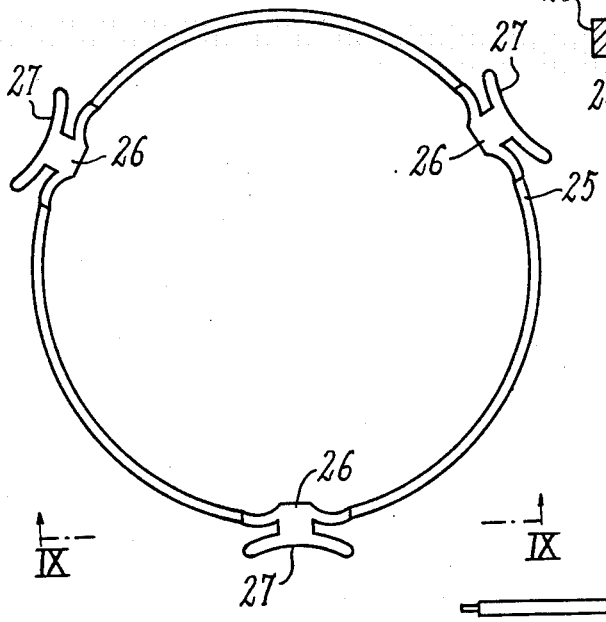
FIG. 8 is a plane view from above of one of the elements shown in FIG. 7.
Figure 9:
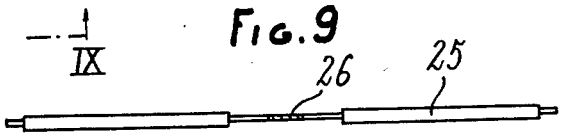
FIG. 9 is an elevation view, partly in cross-section, substantially taken along line IX—IX of FIG. 8.
Figure 10:
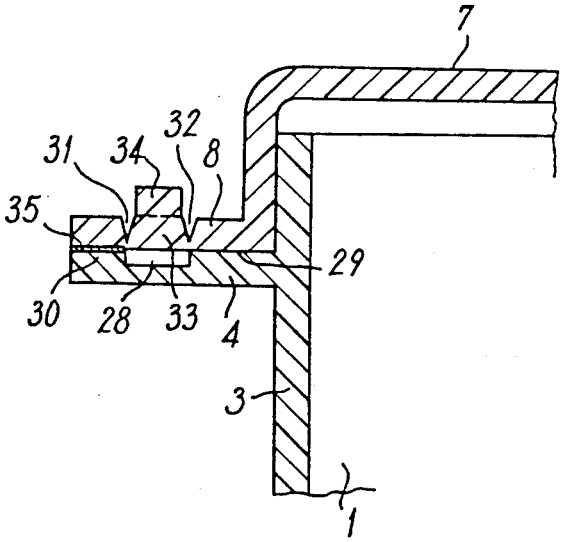
FIG. 10 is a partial diagrammatic cross-section of a box according to the invention.
Figure 11:
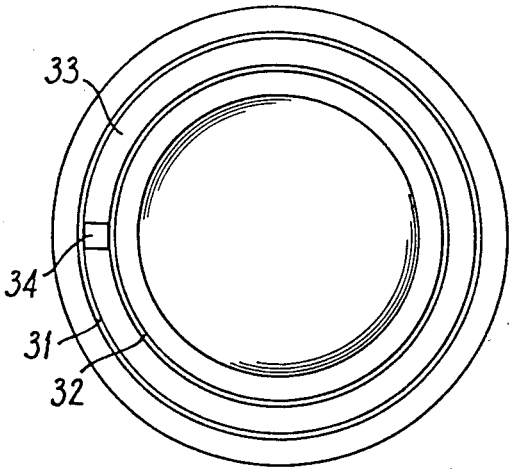
FIG. 11 is a plane view from above corresponding to FIG. 10 but at smaller scale than this figure.

FIGS. 7-9 show a variant of the means for opening the box, which can be made as described in reference either to FIGS. 1-4 or to FIG. 6.

In this embodiment, the soldered area 21 is provided between two protruding parts 4a and 8a of the flanges 4 and 8, and these flanges form, at the periphery of the soldered area 21, a recess 22 closed by bearing annuli 23 and 24. The annuli 23 and 24 are used for maintaining therebetween a separating ring made for example by a keeper of a rectangular cross-section forming cutting parts 26, for example three in number and shifted by 120° the one respect to the other.

Pawls 27 are provided opposite the cutting parts 26 for protruding outwardly of the flanges 4 and 8. For opening the box, it is sufficient for the user to apply his fingers on the three pawls 27 in order to contract the separating ring 25 the cutting parts 26 of which cuts the soldered area 21. The separating ring is then caused to rotate by 120° in order that the cutting part 26 will completely cut the soldered area 21.

It is remarkable to notice that the embodiments as described above both in reference to FIGS. 5 and 6 and in reference to FIGS. 7-9, permit, as in the preceeding embodiment of FIGS. 1-4, a continuous use of the box after its initial opening.

In FIGS. 10-14, the body 1 of the box comprises a raising wall 3 which forms a peripheral flange 4. The box is provided with a lid 7 forming also a flange 8 which corresponds to the flange 4 of the body.

The flange 4 has at its upper wall a peripheral groove 28 on both sides of which are formed two segments 29, 30. The edge of the segments 29, 30 which are adjacent to the groove 28 have an acute angle.

The flange 8 has opposite the above edges, peripheral breakage starts 31, 32. In this manner an annular segment 33 extends above the peripheral groove 28. At least one button 34 is provided above the segment 33.

When the box is filled up and the lid 7 is positioned, the lid is then soldered which is made for example by vibrations. The solder is formed at the periphery of the flanges in order that only the portions of the flange 8 of the lid extending beyond the breakage start 31 is soldered on the segment 30. The peripheral groove 28 prevents that the solder can extend inwardly so that a soldered ring of a uniform width is formed.

When it is desired to open the box, it is sufficient to exert a pressure on the button 34, which breaks the flange 8 at the breakage starts 31, 32. By pulling on the button 34, all the annular segment 33 is torn-off which makes that the lid 7 can be easily withdrawn and then repositioned if the content of the box is not entirely used.

Figure 12:
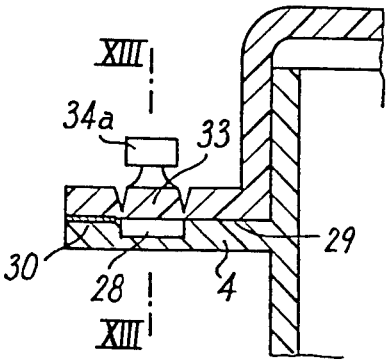
FIG. 12 is a partial cross-section similar to FIG. 10 of a variant of embodiment.
Figure 13:
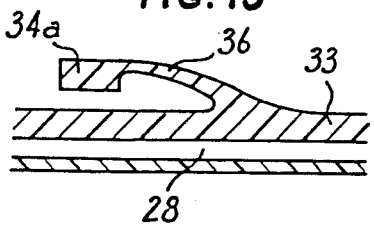
FIG. 13 is a cross-section view taken along line XIII—XIII of FIG. 12.

FIGS. 12 and 13 show a slight variant of embodiment according to which the button 34a is formed at end of a lug 36 being itself a part of the annular segment 33. In this embodiment, when opening the box, a pressure is first exerted as previously on the button 34a for breaking the annular segment 33 and a pull is then exerted for tearingoff said segment 33. The lug 36 which is a flexible lug facilitates tearing-off the segment 33.

The peripheral groove 28 can be formed in the lid flange and in this case the breakage ring or annular segment 33 is formed in the box flange.

I claim:

1. A box forming a container for various products, particularly alimentary products, comprising a body forming a peripheral flange and a lid, said lid having peripheral portion bearing on the peripheral flange and soldered to said peripheral flange on a soldered area, wherein the soldered area extends over a width smaller than the width of the peripheral flange, and means, provided on at least one of said peripheral flange and said peripheral portion of the lid, for breaking at least a part of the peripheral portion of said lid away from the container periphery, said breaking means comprising a groove extending about one of the peripheral flange and the peripheral portion of the lid, said soldered area being formed along the outer periphery of said groove.

2. A box accroding to claim 1, wherein the box has a raising side edge (3) and the lid (7) forms a flange (8) and is shaped for making encasing means with the raising side edge (3) of the box, the soldered area (21) being provided between the flanges (4, 8) and a part only of the length thereof.

3. Box according to claim 2, wherein the flanges are provided with breakage grooves (**9, 9*a***) on this side of the soldered area.

4. Box according to claim 2, wherein the flanges form therebetween a recess (17) at periphery of which is formed the soldered area (21) which connects the flanges, said recess containing a wire (18) having one end fixed to at least one of the flanges while other end of the wire (18) passes through the soldered area and protrudes outwardly of the flanges.

5. A box according to claim 2, wherein the flanges form therebetween a recess (22) formed outwardly of the soldered area (21), said recess containing a separating ring (25) provided with cutting means (26) for cutting the soldered area.

6. A box according to claim 5, wherein the separating ring (25) is a keeper maintained between bearing annuli (23, 24) and comprises on its inner side three cutting part (26) shifted by 120° and opposite to which are formed pawls (27), said pawls protruding outwardly of the flanges.

7. A box according to claim 2, wherein the lid is made for being encased inside the box, the flanges being formed beyond the encasing parts.

8. A box according to claim 2, wherein the lid is made for being encased outside the box, the flanges being formed beyond the encasing parts.

9. A box according to claim 1, wherein the box and the lid are made of plastics material, said plastics material resisting to a temperature higher than 105° C. and preferably near 130° C.

10. A box according to claim 9, wherein the plastics material is polypropylene.

11. A box according to claim 1, wherein the soldered area is made by ultra-sonic vibrations.

12. A box according to claim 1 wherein the box has deformable parts.

13. A box according to claim 1 wherein the lid has deformable parts.

14. A box according to claim 1, wherein the peripheral groove (28) has acute edges.

15. A box according to claim 14, wherein the flange complementary to that comprising the peripheral groove (28) has peripheral breakage starts (31, 32).

16. A box according to claim 15, wherein the peripheral breakage starts (31, 32) are formed opposite raising edges of the peripheral groove (28).

17. A box according to claim 15, wherein an annular segment (33) formed by the breakage starts (31, 32) is provided with at least one pressure button (34).

18. A box according to claim 17 wherein the pressure botton (**34*a***) is connected to the breakage annular segment by a flexible lug.

19. A box according to claim 1, wherein the soldered area forms a ring (35) extending from the outer peripheral edge of the flanges (4, 8) to a first raising edge of the peripherical groove (28).

* * * * *